US005593501A

United States Patent [19]

König et al.

[11] Patent Number: 5,593,501

[45] Date of Patent: Jan. 14, 1997

[54] DEVICE FOR COATING SMALL SOLID BODIES

[75] Inventors: Axel König, Stuttgart; Matthias Kleinhans, Waiblingen; Janéz Michelic, Remseck, all of Germany

[73] Assignee: Santrade Ltd., Lucerne, Switzerland

[21] Appl. No.: 397,213

[22] PCT Filed: Aug. 5, 1994

[86] PCT No.: PCT/EP94/02609

§ 371 Date: May 2, 1995

§ 102(e) Date: May 2, 1995

[87] PCT Pub. No.: WO95/07136

PCT Pub. Date: Mar. 16, 1995

[30] Foreign Application Priority Data

Sep. 10, 1993 [DE] Germany ..... 43 30 633.0

[51] Int. Cl.[6] ..... B01F 5/22

[52] U.S. Cl. ..... 118/410; 118/303; 118/423

[58] Field of Search ..... 118/303, 410, 118/423

[56] References Cited

U.S. PATENT DOCUMENTS 2,944,284 10/1957 Tillotson et al. ..... 18/2.5

3,409,712 7/1966 Chisholm ..... 264/176

4,326,480 4/1982 Glatt ..... 118/303

FOREIGN PATENT DOCUMENTS 0254791 2/1988 European Pat. Off. .

*Primary Examiner*—Lyle A. Alexander

*Attorney, Agent, or Firm*—Burns, Doane, Swecker & Mathis, L.L.P.

[57] ABSTRACT

A device is disclosed for improved coating of small solid particles with a melt of a material which solidifies at room temperature. The device includes a rotatable turbine body and conduits for supplying solid particles and molten material to the rotatable turbine body. The turbine body is rotated by a hollow drive shaft and is provided with a series of heating conduits extending through the drive shaft and the turbine body for heating the turbine body. The turbine body can be heated to a controlled temperature to maintain the molten material at a desired temperature by varying the temperature of a heating agent which is supplied through the heating conduits.

13 Claims, 3 Drawing Sheets

DEVICE FOR COATING SMALL SOLID BODIES

BACKGROUND OF THE INVENTION

The present invention relates to a device for coating small solid particles with a solidifying layer derived from a liquid, where the solid particles and the liquid are supplied axially from one side into a rotating disk-like turbine that is set into rotation via a drive shaft projecting from the side opposite the supply side.

Devices of this type have been known, for example, from EP 0 048 312 A1. In the case of these arrangements, the liquid content, normally formed by the melt of a material that is solid at room temperature, is fed into the system from above through a pipe extending along the axis of the turbine. The solid particles are fed onto the rotating disk via a hopper surrounding the pipe. As a result of the centrifugal force, a fog formed by the liquid is produced at the outer edge of the disk, and the solid particles are guided through this fog before they are spun off to the outside. During this process, the particles are covered by a layer of the liquid, which is then cooled so as to solidify.

The known device does not provide the possibility to heat the turbine to a controlled temperature. However, as it may be important under certain circumstances to heat the melt to an exactly controlled temperature before it emerges from the draw gap, because its viscosity characteristics can be influenced in this way, it is not always easy with the known devices to adhere to and maintain the desired melt temperature in the turbine.

This situation is aggravated by the fact that in the case of the known device the turbine rotates in a housing which also accommodates the turbine shaft bearings. There exists a gap between the housing and the rotating turbine extends into the bearing space. The packing provided in this gap does not in all cases suffice to prevent any product, especially such of a liquid nature, that may collect at the edge of the housing, radially outside the turbine, from settling down.

SUMMARY OF THE INVENTION

It is an object of the present invention to improve a device of the before-mentioned type in such a way that heating of the rotating turbine to an exactly controlled temperature is rendered possible in order to enable the coating process to be effected under defined conditions.

The invention provides, for a device of the before-mentioned type, in which the turbine body can be heated in a controlled way through the drive shaft. Due to this design, it is now possible to obtain the desired controlled temperature at the very point where it is important for the coating process.

According to a further development of the invention, the drive shaft may be designed as a hollow shaft accommodating the supply and return lines for a heating agent which circulates through heating channels that are uniformly distributed in the turbine body. In this case, it is provided according to a further development of the invention that these heating channels run in a star-like pattern from the axis of rotation of the turbine body to the outside and back to the center. A supply pipe for a heating agent, effecting the supply of the heating agent to the turbine body, is guided in the hollow shaft in such a way as to rotate with the hollow shaft. The return of the heating agent takes place through the gap formed in the hollow body surrounding the supply pipe.

This design enables a heating agent to be supplied and carried off in a simple way. However, it also requires that the supply pipe, which rotates together with the hollow shaft, must be sealed relative to the stationary housing. This is achieved in a particularly advantageous way by the fact that the lower end of the supply pipe is guided in a stationary packing sleeve, and is sealed relative to the inside of the sleeve by a labyrinth packing. Further, the supply pipe is guided on its inside on a stationary pipe connection and is sealed relative to the stationary pipe by another labyrinth packing. It has been found that a particularly good sealing effect is achieved in this way when the supply pipe rotates together with the turbine. The return of the agent is then effected through a downwardly open hollow pipe and out of the hollow pipe into a discharge space.

Since in the case of this embodiment the product supply, i.e. the supply of both the solid particles and the liquid, occurs from the top, one designs the supply for the liquid under space considerations in such a way that a pipe which is at first axially directed toward the turbine is bent in radially outward direction inside the axial solid body supply pipe. The radial section of the liquid supply pipe is then covered by a roof-like screening structure in order to prevent undesirable heating of the solid particles by the supply pipe for the liquid product which is designed as heated double-walled pipe. At the delivery point between the rotating turbine and the stationary double-walled supply pipe, a fixed, radially projecting cutter may be mounted on the double-walled supply pipe for continuously removing, during rotation of the turbine, any material tending to deposit on the upper edge of the rotating turbine at the delivery point.

BRIEF DESCRIPTION OF THE DRAWINGS

The invention will now be described with reference to one embodiment illustrated in the drawing, in which.

DETAILED DESCRIPTION OF THE PREFERRED EMBODIMENTS OF THE INVENTION

Figure 1:
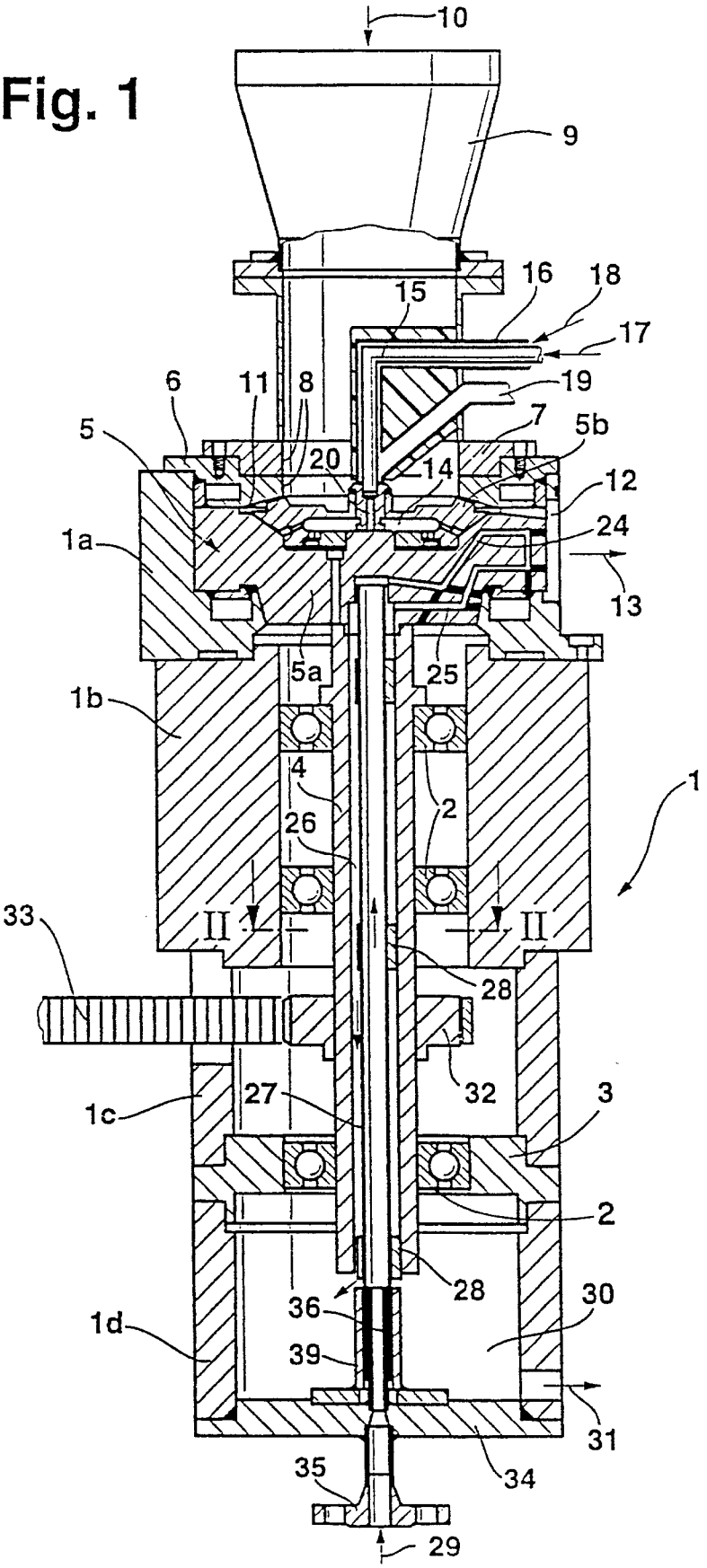
FIG. 1 is a diagrammatic longitudinal section through a device for coating solid bodies according to the invention.

FIG. 1 shows a device intended for coating small solid particles with a layer derived from a liquid, which then solidifies at room temperature. The device according to FIG. 1 comprises a substantially cylindrical housing (1), built up from a plurality of parts, which in the case of the illustrated embodiment consists of four parts (1*a*, 1*b*, 1*c* and 1*d*) of substantially annular shape. This design has been selected for ease of assembly, however, housings having differing shapes and numbers of parts are within the scope of the invention. The housing ring (1*b*) contains two bearings (2) for a hollow shaft (4). The housing ring is additionally supported by a bearing (2) arranged on a bearing ring (3) inserted between the housing rings (1*c* and 1*d*).

The upper end of the hollow shaft (4) is firmly connected with a turbine body (5) which is rotatably mounted in the housing ring (1*a*). In the case of the preferred embodiment of the invention, the turbine body consists of the lower part (5*a*), which is firmly connected with the hollow shaft (4) and is screwed together with an upper part (5*b*) of smaller diameter. The housing part (1*a*) is closed on top by a cover ring (6) and a cover (7) both having a central opening (8) through which the solid particles, that are introduced from the top through a hopper (9) in the direction of arrow (10), can be supplied onto the surface of the turbine part (5*b*). The part (5*b*) is provided, in the known manner, with radially extending turbine blades which are not shown in detail. During rotation of the turbine part (5*b*), the solid particles, which may for example exhibit the form of small, uniform grains, are fed radially outward into a circumferential annular space (11) that can be better seen in FIG. 3. From this annular space (11), the solid particles, being entrained by the rotation of the turbine body, are then carried off in the direction indicated by arrow (13), through an opening (12) leading out of the annular space (11) in either a tangential or radial direction to a cooling section.

The part (5*b*) of the turbine body (5) further comprises an inner space (14) (see also FIG. 3) into which a supply pipe (15) arriving from the top delivers the second material employed for coating the solid particles, which material is supplied into the system as a melt, in the liquid phase. Considering that this material must solidify at room temperature and is intended to form the layer covering the individual solid particles, this material is introduced in heated, molten condition. The supply pipe (15) is surrounded for this purpose by a heating jacket (16). Consequently, the liquid product, while being fed in the direction of arrow (17) is surrounded by a heating liquid which latter is supplied into the space of the jacket (16) in the direction of arrow (18) and carried off to the outside through the pipe (19).

The lower end of the stationary pipe (15) is held in a supply pipe connection (20), the latter being sealed by a labyrinth packing against a collar (21) (FIG. 3) projecting upward from the turbine part (5*b*). The liquid supplied in the direction of arrow (17) enters the inner space (14) through this supply pipe connection (20) and due to the centrifugal forces imparted to the liquid by the rotary movement the liquid can pass through bores (22) arranged radially in the part (5*b*) and enter an annular slot (23) that opens into the annular space (11). The space (14), the bores (22), the slot (23), and the space (11) form a melt passage for conducting the melt. Thus, during operation, the annular space (11) contains not only the solid particles, but also a fog formed by the liquid phase as a result of the rotary movement. During rotation inside the space (11), the solid particles are, therefore, coated in the desired way with a layer of the material that has been fed into the system in liquid form and that is then allowed to solidify.

Figure 2:
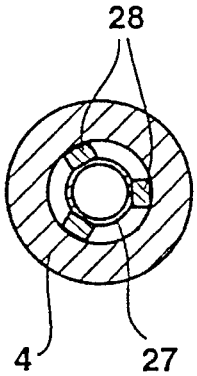
FIG. 2 is a somewhat enlarged representation of the section through the device according to FIG. 1, taken along line II—II.

In order to guarantee that the temperature of the liquid phase (14) is maintained in the space (11), the part (5*a*) of the turbine body (5) is provided with radial channels (24) that are guided in closed circuit from a central space to channels (25) leading to the interior (26) of the hollow shaft (4). Inside the hollow shaft (4), there is provided, in coaxial arrangement (see also FIG. 2) a supply pipe (27) which is mounted on the part (5*a*) and which rotates together with the latter, and which is retained in this coaxial position by spacers (28). The spacers (28) are designed so as to form passages for the heating agent that returns inside the space (26) and that is guided into the supply pipe (27) from below, in the direction indicated by arrow (29). After the heating agent has passed through the heating channels (24 and 25) in the part (5*a*), it leaves the arrangement through the hollow space (26) and flows into a collecting space (30) inside the housing ring (1*d*), from where it can be carried off to the outside in the direction of arrow (31).

It is apparent from FIG. 1 that the hollow shaft (4) is provided with a pinion (32) that coacts with a toothed belt (33) for driving the hollow shaft (4) and the turbine body (5).

Given the fact that the supply pipe (27), is arranged inside the hollow shaft (4) and coaxially with the hollow shaft which rotates together with the turbine body (5), the supply pipe has to be sealed at its lower end.

Figure 6:
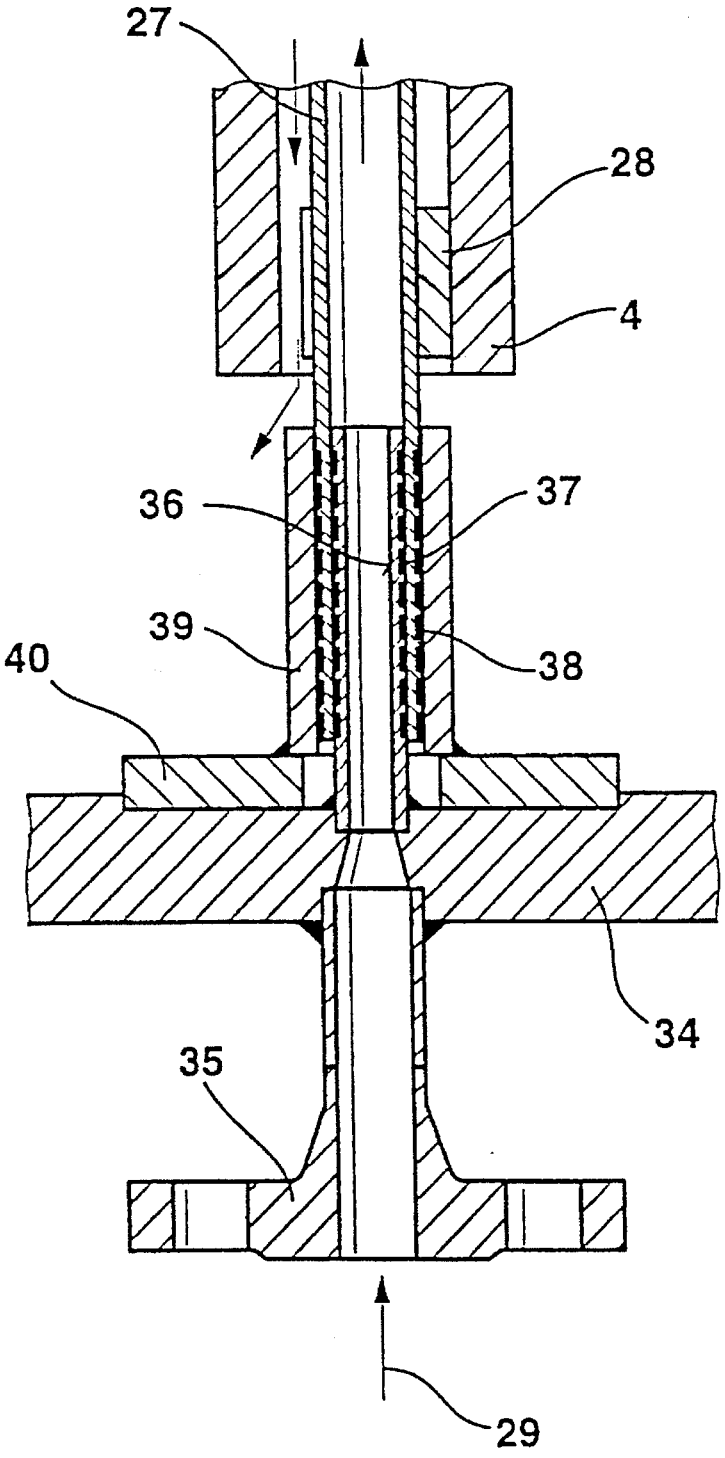
FIG. 6 is an enlarged representation of the packing of the supply pipe for the heating agent of the device according to FIG. 1.

As can be seen in FIG. 6, the lower cover (34) is provided for this purpose with a fixed connection piece that terminates by a fixed connecting sleeve (36) extending into the interior of the connection pipe (27). FIG. 6 shows that the connecting sleeve (36) is surrounded on its outside by a labyrinth packing (37) that coacts with the lower end of the connection pipe (27). However, FIG. 6 also shows that the outside of the lower end of the connection pipe (27) itself is also provided with a labyrinth packing (38) that coacts with a fixed bushing (39) which is screwed onto the cover (34) via a flange (40). This design enables a particularly efficient sealing effect to be ensured for the supplied heating agent although both the hollow shaft (4) and the supply pipe (27) guided coaxially therein perform a rotating movement. This prevents any notable loss of heating agent. Any leakage is guided into the space (30) from where it can be removed.

Figure 3:
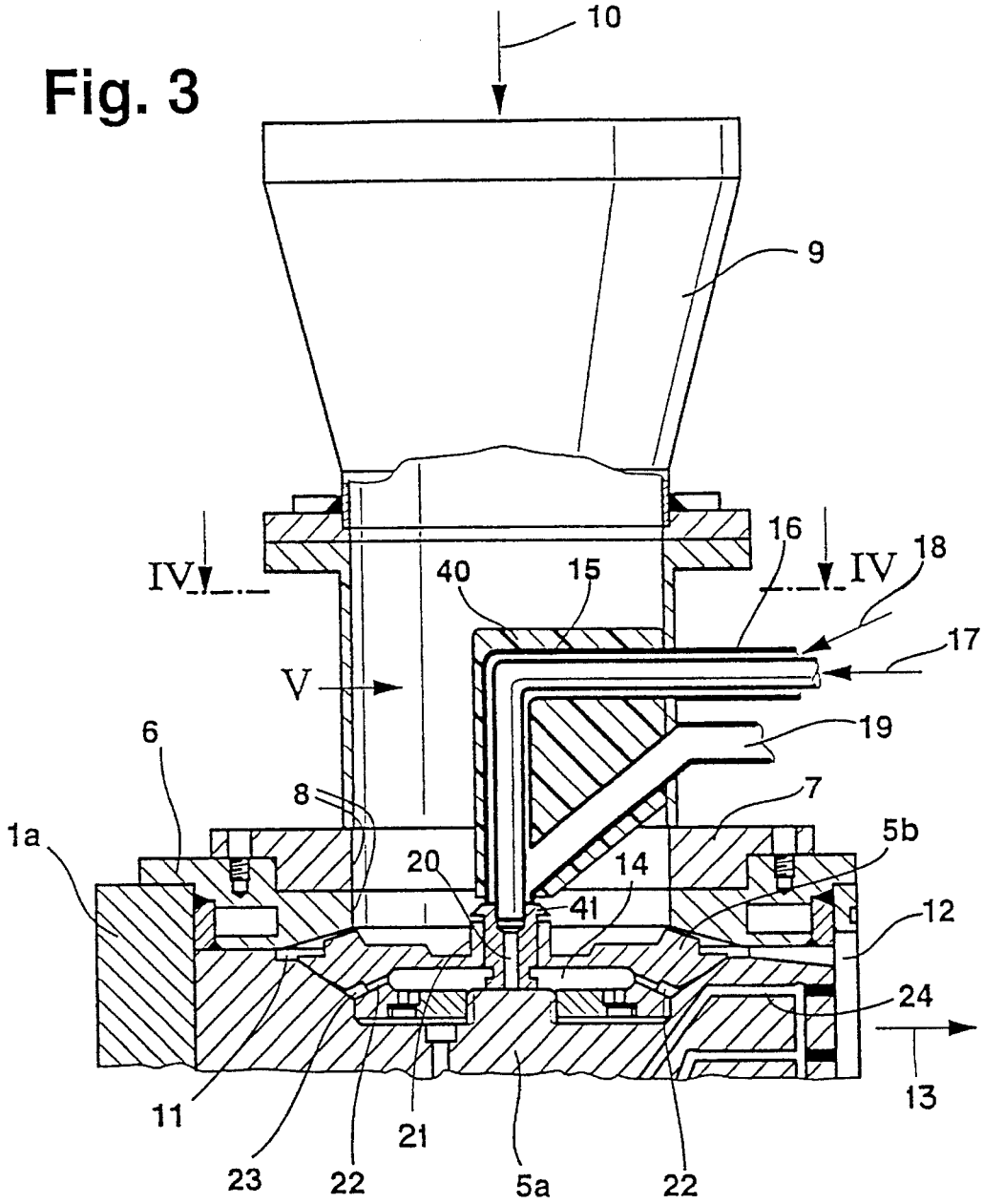
FIG. 3 is an enlarged representation of the upper part of the device according to FIG. 1.
Figure 4:
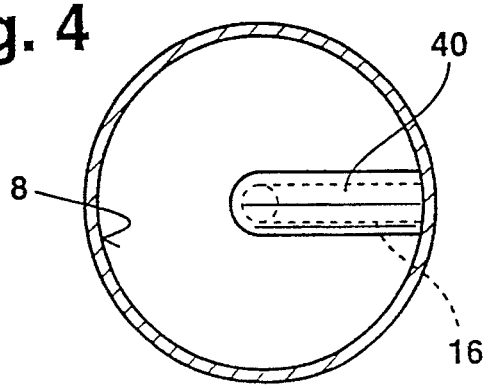
FIG. 4 is a section through FIG. 3, taken along line IV—IV.
Figure 5:
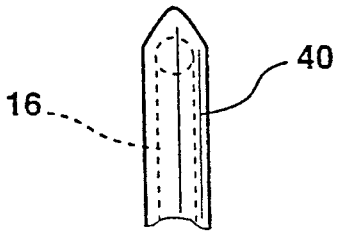
FIG. 5 is a partial view according to FIG. 3, viewed in the direction indicated by arrow V.

From FIGS. 4 and 5, regarded jointly with FIGS. 1 and 3, it can be noted that the supply pipe (15) or its heating jacket (16) is screened relative to the solid particles, that are fed into the turbine body axially from above, by a protective cover (40) projecting in a roof-like shape in upward direction, against the supply direction indicated by arrow (10). This covering (40) acts to insulate the hot jacket (16) from the outside and to prevent the solid particle product supplied into the system from adhering to the heating jacket (16) and melting in an undesirable way.

It should also be noted that a stationary cutter (41) in the form of radially projecting cutter points, mounted to move relative to the rotating upside of the collar (21), is provided at the transition between the supply pipe (15)—including its heating jacket (16)—and the pipe connection (20). These cutter points (41) help ensure that no product residues, that might obstruct the further operation, can settle on the upside of the collar.

A decisive aspect of the new device is seen in the ability to heat the turbine body (5) directly and in a controlled way. This can be achieved by adjusting the liquid heating agent, being supplied into the system in the direction of arrow (29), to a given controlled temperature. This can be achieved without any difficulty when the heating agent is circulated in a closed circuit. It is also possible at any time to vary the temperature so as to adjust it to the particular coating process whenever this should become necessary.

We claim:

1. A device for coating solid particles with a coating material which is solid at room temperature comprising:

a housing;

a rotatable turbine body mounted within the housing and including heating channels and a separate melt passage formed therein;

a drive shaft connected to the turbine body for rotating the turbine body;

a first conduit for supplying a melt of a coating material to the melt passage of the rotatable turbine body; and a second conduit for supplying solid particles to be coated to the rotatable turbine body, the melt passage arranged to conduct melt to the particles to coat the particles;

the drive shaft being hollow to define therein a space accommodating a flow of heating agent to the heating channels to heat the turbine body independently of the melt and maintain the melt in a liquid state.

2. The device according claim 1, wherein the heating channels run in a star-like pattern from an axis of rotation of the turbine body to an outside of the turbine body and back to the axis of rotation.

3. The device according to claim 1, wherein the second conduit comprises a hopper.

4. The device according to claim 1, wherein both the first conduit and the second conduit project from a side of the rotatable turbine which is opposite the side to which the drive shaft is connected.

5. The device according to claim 1, further comprising a first conduit connection between the first conduit and the rotatable turbine body and a stationary cutter provided on an end of the first conduit that faces the turbine body said stationary cutter preventing residue from developing on an upper edge of the turbine body surrounding the first conduit connection.

6. The device according to claim 1 wherein said turbine body includes upper and lower parts fixedly secured together, the first and second conduits communicating with the upper part, and the heating channels being formed in the lower part.

7. The device according to claim 1, wherein the first conduit is surrounded by a heated outer jacket.

8. The device according to claim 7, wherein the heated outer jacket extends at least partially in a radial direction with respect to an axis of rotation of the turbine and wherein the portion of the heated outer jacket which extends radially is protected by a cover.

9. The device according to claim 1 further including a supply pipe extending within the space formed by the drive shaft for conducting the heating agent.

10. The device according to claim 9, wherein the supply pipe has a smaller outer diameter than the inner diameter of the hollow shaft so that an annular space remains between the hollow shaft and the supply pipe, said annular space provided for the return of the heating agent.

11. The device according to claim 9, wherein the supply pipe is connected with the turbine body so as to rotate with the turbine body, and a lower end of the supply pipe is sealed by a packing against a fixed pipe connection, which is in contact with a heating agent supply line.

12. The device according to claim 11, wherein the lower end of the supply pipe is provided on an outer circumference with a packing which has the effect of sealing the supply pipe against a fixed packing sleeve.

13. The device according to claim 11, wherein a pipe connection piece projects into the supply pipe in the area of the packing, the connection piece being provided on its outside with a packing that coacts with the inner diameter of the supply pipe to provide a sealing effect.

* * * * *